United States Patent [19]

Pearce et al.

[11] Patent Number: 4,730,677

[45] Date of Patent: Mar. 15, 1988

[54] METHOD AND SYSTEM FOR MAINTENANCE AND SERVICING OF SUBSEA WELLS

[75] Inventors: Joseph L. Pearce; Phillip S. Sizer, both of Dallas; John C. Gano, Carrollton; John H. Yonker, Carrollton; Robert L. Thurman, Carrollton; James F. O'Sullivan, Jr., Houston; Dayton M. Simpson, Missouri City; Richard A. Roberts, Houston, all of Tex.; Anthony J. Healey, Carmel, Calif.; Urie G. Nooteboom, Houston, Tex.

[73] Assignee: Otis Engineering Corporation, Dallas, Tex.

[21] Appl. No.: 944,874

[22] Filed: Dec. 22, 1986

[51] Int. Cl.[4] ..... E21B 43/01

[52] U.S. Cl. ..... 166/345; 166/346; 166/359; 405/195

[58] Field of Search ..... 166/345, 346, 350, 352, 166/359, 367; 405/195

[56] References Cited

U.S. PATENT DOCUMENTS

| | | | |
|---|---|---|---|
| 2,060,670 | 11/1936 | Hartman . | |
| 3,626,703 | 12/1971 | Richburg . | |
| 4,034,568 | 7/1977 | Mason . | |
| 4,176,986 | 12/1979 | Tatt et al. | 405/211 |
| 4,281,716 | 8/1981 | Hall | 166/339 |
| 4,405,016 | 9/1983 | Best | 166/337 |
| 4,423,983 | 1/1984 | Dadiras et al. | 405/195 |
| 4,470,722 | 9/1984 | Gregory | 405/195 |
| 4,544,036 | 10/1985 | Saliger | 166/341 |
| 4,556,340 | 8/1983 | Morton | 405/195 |
| 4,570,716 | 2/1986 | Genini et al. | 166/346 |

*Primary Examiner*—Stephen J. Novosad
*Assistant Examiner*—William P. Neuder
*Attorney, Agent, or Firm*—Thomas R. Felger

[57] ABSTRACT

A system and method for servicing subsea wells with a flexible riser. The flexible riser can be modified for use either with wireline or through the flow line tools. The flexible riser eliminates the requirement for motion or heave compensating equipment associated with rigid marine riser systems. The flexible riser, lower riser package and associated surface support equipment can be used to obtain vertical access to a subsea well without the need to use a drill ship or semisubmersible.

28 Claims, 16 Drawing Figures

METHOD AND SYSTEM FOR MAINTENANCE AND SERVICING OF SUBSEA WELLS

BACKGROUND OF THE INVENTION

1. Field of the Invention

This invention relates to methods and systems for maintenance and servicing of a subsea well with its wellhead located on or near the ocean floor and production flow lines extending therefrom, usually along the ocean floor.

2. Description of Related Art

A wide variety of designs and equipment are used to complete, produce and service offshore oil and gas wells. Some examples include large production platforms with a rigid support structure resting on the ocean floor, moored tension leg platforms, and through flow line (TFL or pumpdown) well completions. These alternative designs and others are motivated by a desire to extract oil and gas from offshore hydrocarbon reservoirs in both an economical and safe manner.

This invention is directed towards maintenance and servicing a subsea well that has been completed without any type of platform structure on the ocean surface above the well. Prior to the present invention, such wells were generally serviced either by TFL techniques or conventional wireline from a drill ship or semisubmersible type vessel. Wireline servicing from such vessels generally requires the use of a fixed riser from the wellhead to the vessel and associated large heave compensation equipment. Therefore, routine wireline service performed on a subsea well may cost several hundreds of thousands of dollars while the same wireline service for a land well might be only a few hundred dollars. One object of the present invention is to substantially reduce the time and cost required to service subsea wells.

U.S. Pat. No. 4,405,016 invented by Michael J. A. Best discloses a typical subsea wellhead and Christmas tree. This patent also teaches equipment and methods for removal of the tree cap to gain vertical access to the well bore below the wellhead for maintenance and servicing of the well bore. U.S. Pat. No. 4,544,036 invented by Kenneth C. Saliger discloses a subsea wellhead, Christmas tree, and associated equipment to allow connecting a production flow line to the Christmas tree. U.S. Pat. No. 4,423,983 invented by Nickiforos G. Dadiras et al discloses a fixed or rigid marine riser extending from a subsea facility to a floating structure located substantially directly thereabove. U.S. Pat. No. 4,470,722 invented by Edward W. Gregory discloses a marine production riser for use between a subsea facility (production manifold, wellhead, etc.) and a semisubmersible production vessel. U.S. Pat. No. 4,176,986 invented by Daniel G. Taft et al discloses a rigid marine drilling riser with variable buoyancy cans. U.S. Pat. No. 4,556,340 to Arthur W. Morton and U.S. Pat. No. 4,570,716 to Maurice Genini et al disclose the use of flexible risers or conduits between a subsea facility and a floating production facility. U.S. Pat. No. 4,281,716 to Johnce E. Hall discloses a flexible riser to allow vertical access to a subsea well to perform wireline maintenance therein. The above patents are incorporated by reference for all purposes within this application.

SUMMARY OF THE INVENTION

The present invention includes a flexible workover riser system and a relatively small support vessel to obtain vertical access to a subsea well and to perform maintenance thereon. The invention includes alternative embodiments to allow either wireline or TFL servicing of the subsea well. The subsea well may be one of several wells drilled and completed through a common template on the ocean floor or a remote satellite well. The present invention is particularly directed towards servicing via vertical access any subsea well having a production flow line(s) extending along the ocean floor.

An object of this invention is to provide a flexible riser maintenance and servicing system which can be carried out using a small vessel, such as a diver support vessel, to permit completion and production from the subsea well without requiring a fixed production platform or a permanent production riser extending vertically from the subsea wellhead.

Another object of this invention is to provide a flexible riser maintenance system which does not require motion compensating equipment typically found on fixed marine riser systems.

Still another object is to provide a method and system for landing and securing a flexible riser to a subsea wellhead to provide vertical access thereto without the use of guidelines.

A further object is to provide a flexible riser maintenance system which does not require divers to attach the riser to a subsea wellhead.

Another object of the invention is to provide a flexible riser with a lower riser package attached thereto. The lower riser package includes hydraulic controls, blowout preventers, and mating and latching surfaces for attachment to a subsea wellhead.

A further object is to provide a flexible riser with variations in buoyancy along its length. The flexible riser does not require heavy duty motion compensating equipment found on drill ships or semisubmersibles.

A still further object is to provide modular surface handling equipment to raise, lower, and operate the flexible riser and attached lower riser package. The surface equipment provides for either TFL or wireline servicing of the subsea well via the flexible riser.

Additional objects and advantages of the invention will be readily apparent to those skilled in the art from studying the attached written specification, drawings and claims.

DESCRIPTION OF THE PREFERRED EMBODIMENTS

Figures 1, 2:
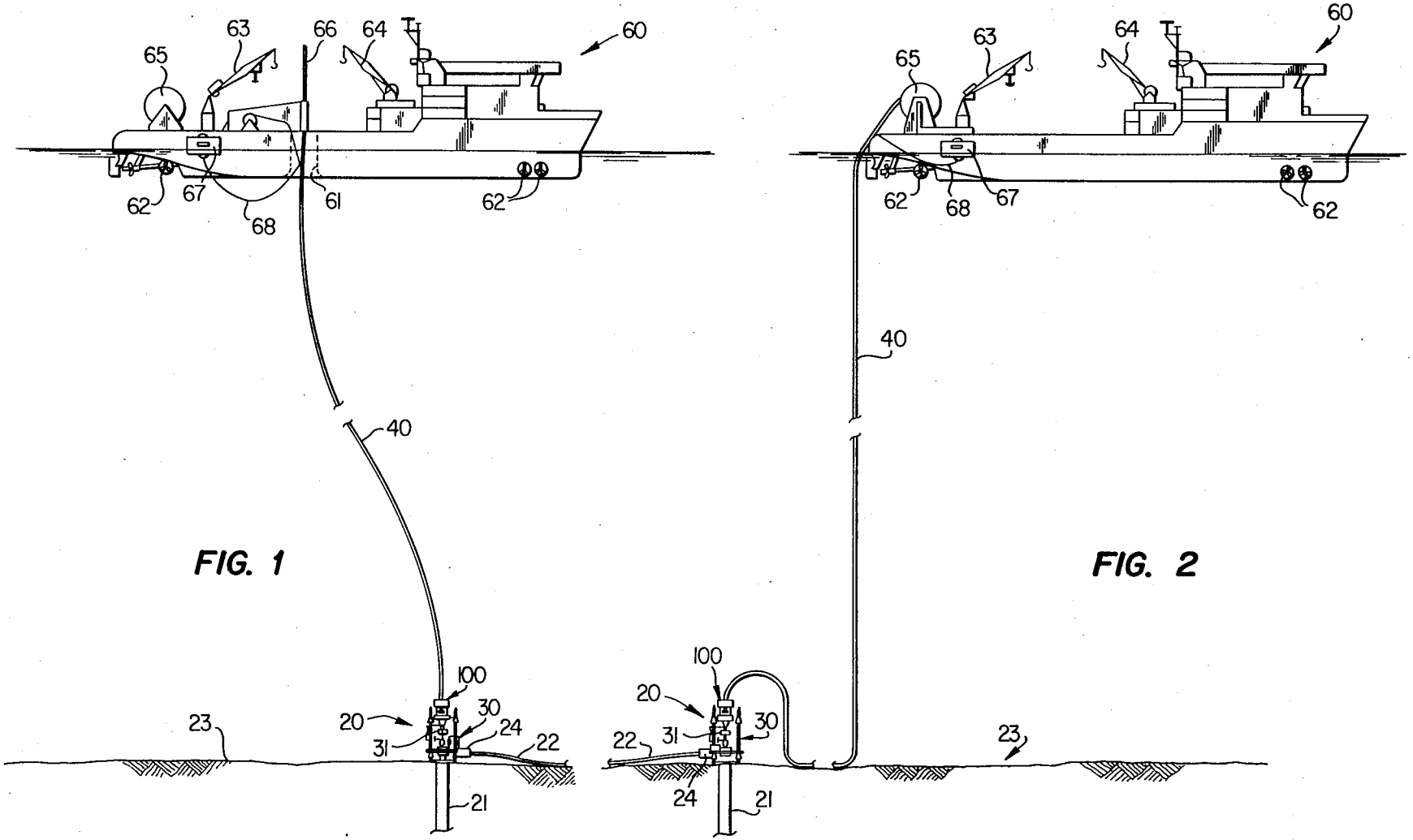
FIG. 1 is a drawing in elevation with portions broken away showing one embodiment of the present invention having a support vessel and flexible riser maintenance system for wireline servicing of a subsea well below the vessel.
FIG. 2 is a drawing in elevation with portions broken away showing an alternative embodiment of the present invention for TFL servicing of a subsea well.

Referring to FIG. 1, subsea well 20 is shown having wellhead 30 and well bore 21 extending downwardly therefrom to one or more hydrocarbon producing formations (not shown). Tubing, casing, production packers, subsurface safety valves and other downhole equipment (not shown) would be disposed within well bore 21 as required for specific well conditions. Production flow line 22 extends from wellhead 30 along the ocean floor 23 to a production facility (not shown). During normal operation, formation fluids flow into well bore 21 and are sent to the production facility via wellhead 30 and production flow line 22.

Support vessel 60 on the ocean surface is shown with flexible riser means 40 extending therefrom. Flexible riser means 40 is attached to wellhead 30 to allow maintenance and servicing of wellbore 21 from support vessel 60. Flexible riser means 40 and support vessel 60 are arranged in FIG. 1 for wireline servicing. Flexible riser means 40 and support vessel 60 are arranged in FIG. 2 for through flow line (TFL) or pumpdown servicing. The difference between wireline and TFL servicing will be explained later.

Support vessel 60 has several thrust motors and propellers 62 which maintain its position on the ocean surface relative to wellhead 30. Flexible riser means 40 can accommodate a substantial variation or offset between the actual position of vessel 60 and the point directly above wellhead 30. Also, well fluids are not produced through flexible riser means 40 since flow line 22 is available. Therefore, the present invention can be used on a much wider variety of support vessels and is not limited to support vessels having highly accurate, expensive position keeping or fluid handling capabilities.

Support vessel 60 has a large opening or moonpool 61 extending from its main deck through its bottom. Moonpool 61 provides a protected area for handling and working with objects in the water below vessel 60. Conventional cranes 63 and 64 are provided on support vessel 60 to position flexible riser means 40 and other components of the maintenance system relative to moonpool 61.

Powered reel 65 is provided on vessel 60 to pay out, take in and store flexible riser means 40. In FIG. 1, conventional wireline lubricator 66 is attached to the terminal end of flexible riser means 40 on vessel 60. Buoy 67, carried on the side of vessel 60, is attached by cable 68 near the upper end of flexible riser means 40. During an emergency such as a storm, riser means 40 and buoy 67 could be released from support vessel 60. After the emergency has past or been corrected, support vessel 60 can locate buoy 67 and reconnect to riser means 60. Alternative disconnect procedures will be described later.

Subsea wellhead systems such as wellhead 30 have several distinct subsystems. The design of each wellhead and its subsystems varies between each major wellhead manufacturer. The principal subsystems include surface conductor pipe (not shown), suspension system (hangers) (not shown) for casing and tubing strings, guide base 50 and guide post 51, Christmas tree 31, and flow line connector 24. The present invention can be used with any subsea wellhead. The written specification will describe the present invention in relationship to a typical subsea wellhead 30 and subsea Christmas tree 31.

Figure 3:
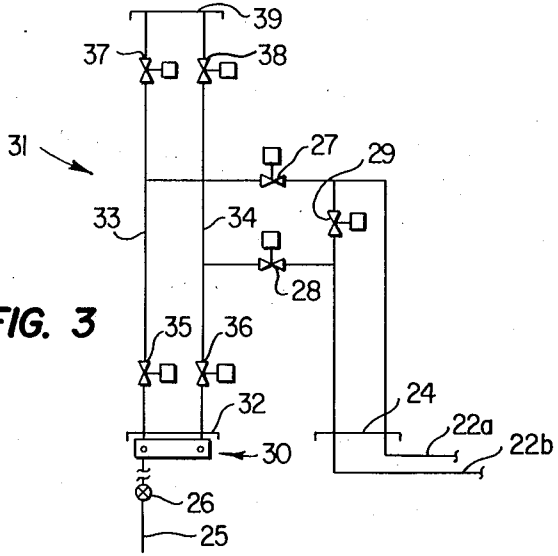
FIG. 3 is a schematic representation of the fluid flow path and major control valves associated with a typical wireline serviced subsea wellhead.

FIG. 3 is a schematic drawing of the fluid flow path and major control valves typically associated with wellhead 30 for a single tubing string, wireline completion. Tubing string 25, disposed within well bore 21, would extend from wellhead 30 to a hydrocarbon producing formation (not shown). Subsurface safety valve 26 is generally installed in tubing string 25 below wellhead 30 to provide emergency shutoff of fluid flow in the event of damage to wellhead 30, Christmas tree 31, or flow lines 22. Christmas tree 31 is attached to wellhead 30 by tree connector 32. Tree 31 has two fluid flow passageways 33 and 34 extending longitudinally therethrough. Flow passageway 33 provides fluid communication and vertical access to tubing string 25. Flow passageway 34 provides fluid communication with the annulus between tubing 25 and well bore 21. Master valves 35 and 36 control fluid flow through passageways 33 and 34 respectively. The extreme upper end of both passageways 33 and 34 is sealed by removable tree cap 39. Swab valves 37 and 38 are provided below tree cap 39 to control access (fluid flow and/or service tools) into passageway 33 and 34 respectively. Removal of tree cap 39 is the first step in performing maintenance on well bore 21. Wing valves 27 and 28 are provided to control fluid flow from passageway 33 and 34 respectively into flow lines 22*a* and 22*b*. Flow line connector 24 provides a means for releasably attaching flow lines 22*a* and 22*b* to Christmas tree 31. An example of a Christmas tree, tree cap and tree cap running tool is shown in U.S. Pat. No. 4,405,016. An example of a flow line connector is shown in U.S. Pat. No. 4,544,036.

Figure 4:
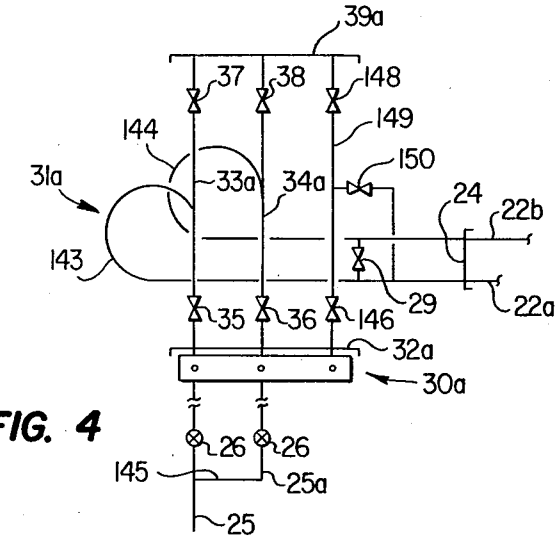
FIG. 4 is a schematic representation of the fluid flow path and major control valves associated with a typical TFL serviced subsea wellhead.

FIG. 4 is a schematic drawing of the fluid flow path and major control valves typically associated with wellhead 30*a* for a TFL type well completion. Tubing string 25, disposed within well bore 21, would extend from wellhead 30*a* to a hydrocarbon producing formation (not shown). For TFL servicing, second tubing string 25*a* is also disposed in well bore 21 to provide fluid communication from wellhead 30*a* to crossover 145. Second tubing string 25*a* and crossover 145 are used to provide a fluid flow path to pump TFL tool strings into and out of tubing string 25. Subsurface safety valves 26 are generally installed in tubing strings 25 and 25*a* for the same reasons as described for FIG. 3. A major difference between Christmas trees 31*a* and 31 is the addition of TFL loops 143 and 144 which facilitate movement of TFL tools from flow lines 22*a* and 22*b* into longitudinal flow passageway 33*a* and 34*a* respectively. Another difference is that Christmas tree 31*a* has fluid flow passageways 33*a*, 34*a*, and 149 extending longitudinally therethrough. Flow passageways 33*a*, 34*a*, and 149 communicate with tubing strings 25, 25*a* and the annulus in well bore 21 respectively. Master valves 35, 36, and 146 and swab valves 37, 38, and 148 perform the same function as previously described for wellhead 30 (FIG. 3). Tree cap 39*a* can be removed to allow vertical access to flow passageways 33*a*, 34*a* and 149.

Figure 5:
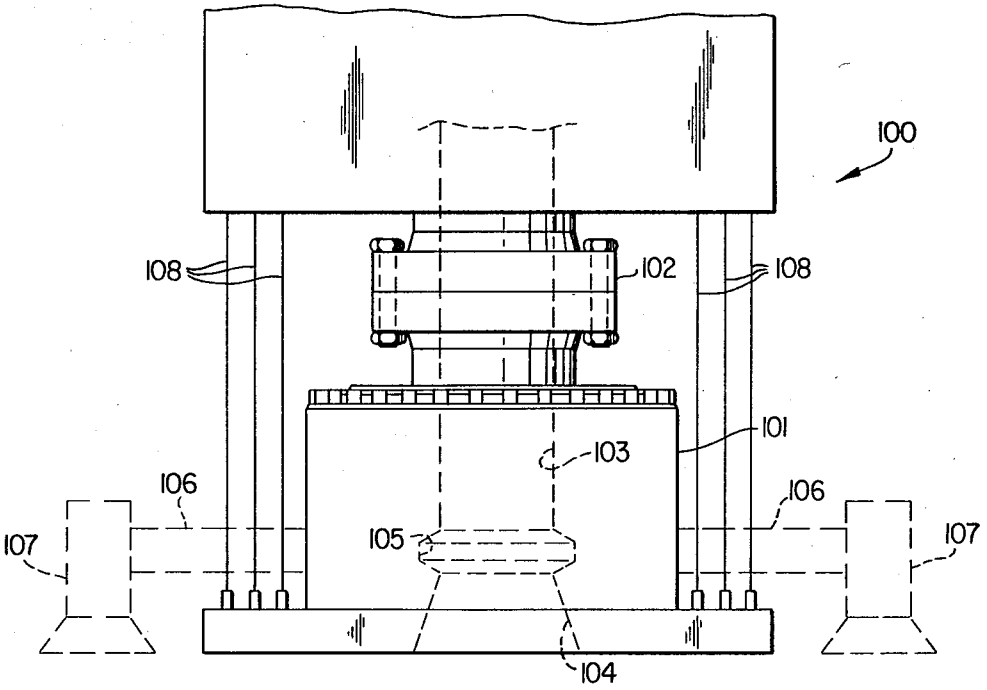
FIG. 5 is a schematic representation of a lower riser package and tieback tool for attachment to a subsea wellhead.

FIG. 5 shows lower riser package 100 attached to tieback tool 101 by flanged connection 102. Lower riser package 100 functions as an interface between flexible riser means 40 and subsea tree 31 to provide both well control (subsurface safety valve 26) and tree control (valves 35, 36, 37, 38, etc.). Tieback tool 101 is preferably a tree running tool or wellhead connector means designed to releasably engage the specific Christmas tree used on wellhead 30. Using the appropriate tree running tool, available from the wellhead manufacturer, allows lower riser package 100 to service a wide variety of subsea wells. Flanged connection 102 can be readily adapted to accommodate any tree running tool as part of lower riser package 100. Tieback tool 101 has fluid flow passageways 103 extending longitudinally therethrough. Guide surface 104 and recess 105 are provided in passageway 103 to attach tieback tool 101 to a Christmas tree such as tree 31 or 31*a*. Guide surface 104 and recess 105 function as mating and sealing surfaces to releasably engage lower riser package 100 to wellhead 30 and to establish communication with wellhead 30 via Christmas tree 31. Guide arms 106 and funnels 107 may also be provided as part of tieback tool 101 to aid in aligning lower riser package 100 with the Christmas tree. The use of guide arm 106 and the design of funnel 107 is a function of the specific Christmas tree and wellhead design. Funnels 107 are designed for use with guide posts 51. A plurality of hydraulic/electric control lines 108 are attached to tieback tool 101 to allow control of master valves 35 and 36, swab valves 37 and 38 and the other components of tree 31. These control functions are part of the design of a tree running tool. One or more flow passageways 103 can be provided depending upon the Christmas tree design.

Figure 6:
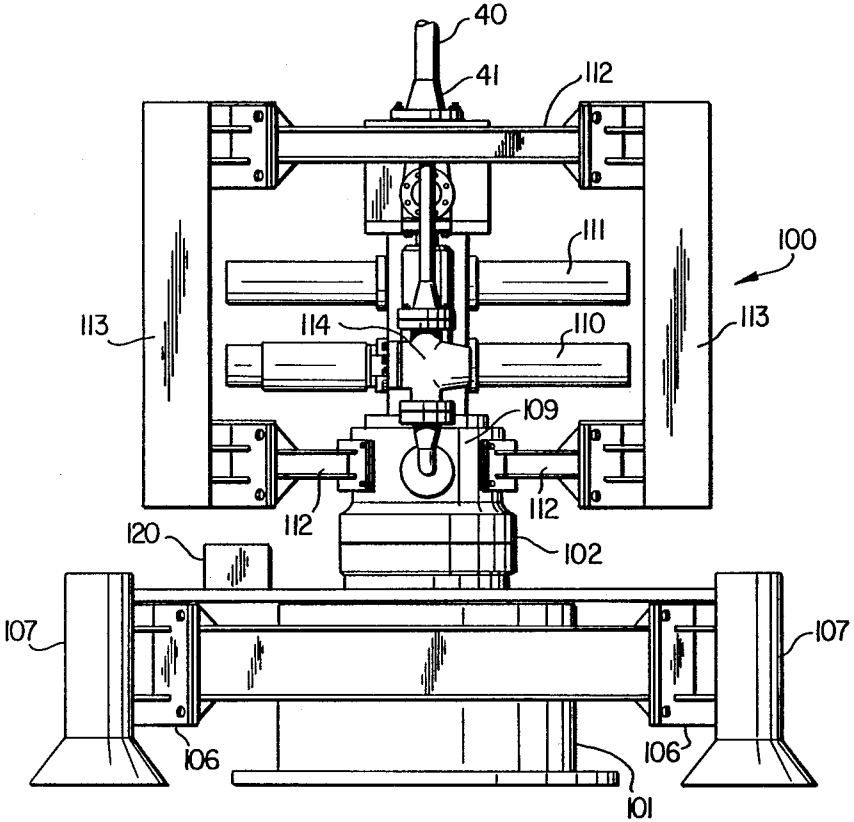
FIG. 6 is a drawing in elevation showing the lower riser package and tieback tool of FIG. 5 in more detail.

A more detailed drawing of lower riser package 100 is shown in FIG. 6. Adapter spool 109 is used to attach blowout preventer 110 and 111 to flanged connection 102. Preferably blowout preventer 110 would have shear rams and preventer 111 blind rams. However, any combination of commercially available blowout preventers could be used with lower riser package 100. Monitor valve 114 is provided to communicate with the annulus (not shown) between well bore 21 and tubing string 25. Flexible riser means 40 is attached to lower riser package 100 by connector 41. Frame 112 is secured to adapter spool 109 and surrounds blowout preventers 110 and 111 to provide support and protection. Buoyant material 113 can be attached to frame 112 as desired to adjust the buoyance of lower riser package 100. During most installations, lower riser package 100 should preferably have slightly negative buoyancy to minimize the forces required to position lower riser package 100. Tag line winch 120 is also carried on lower riser package 100. Winch 120 is an important feature of the present invention to allow safe mating of lower riser package 100 with a Christmas tree.

Figure 7:
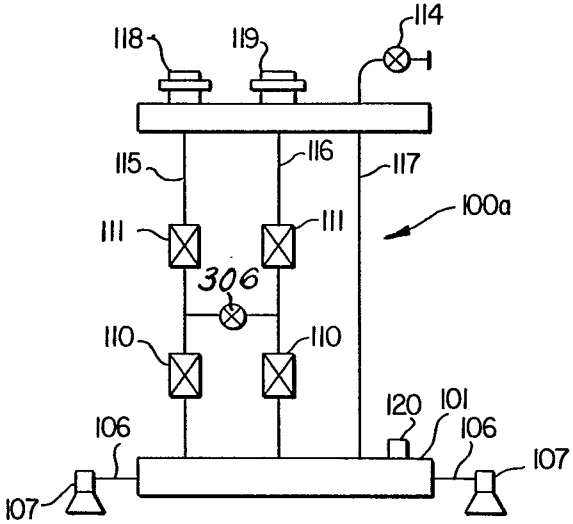
FIG. 7 is a schematic representation of the fluid flow path and major control valves for the lower riser package of FIG. 6.

FIG. 7 is a schematic representation of the fluid flow path and major control valves for lower riser package 100*a* which is designed for use with Christmas tree 31*a*. Lower riser package 100*a* has three longitudinal flow passageways 115, 116, and 117 arranged to communicate with longitudinal flow passageways 33*a*, 34*a*, and 149, respectively, of tree 31*a*. Connector means or unions 118 and 119 are provided on lower riser package 100*a* to allow flexible riser means 40 to communicate with flow passageways 115 and 116. Tieback tool 101 assures proper mating and sealing with the respective flow passageways in tree 31*a*. Cross connect valve 306 may be hydraulically controlled for selected fluid communication between longitudinal flow passageways 115 and 116. Such fluid communication may be required for TFL work string movement or to flush riser means 40 for pollution control.

Figure 8:
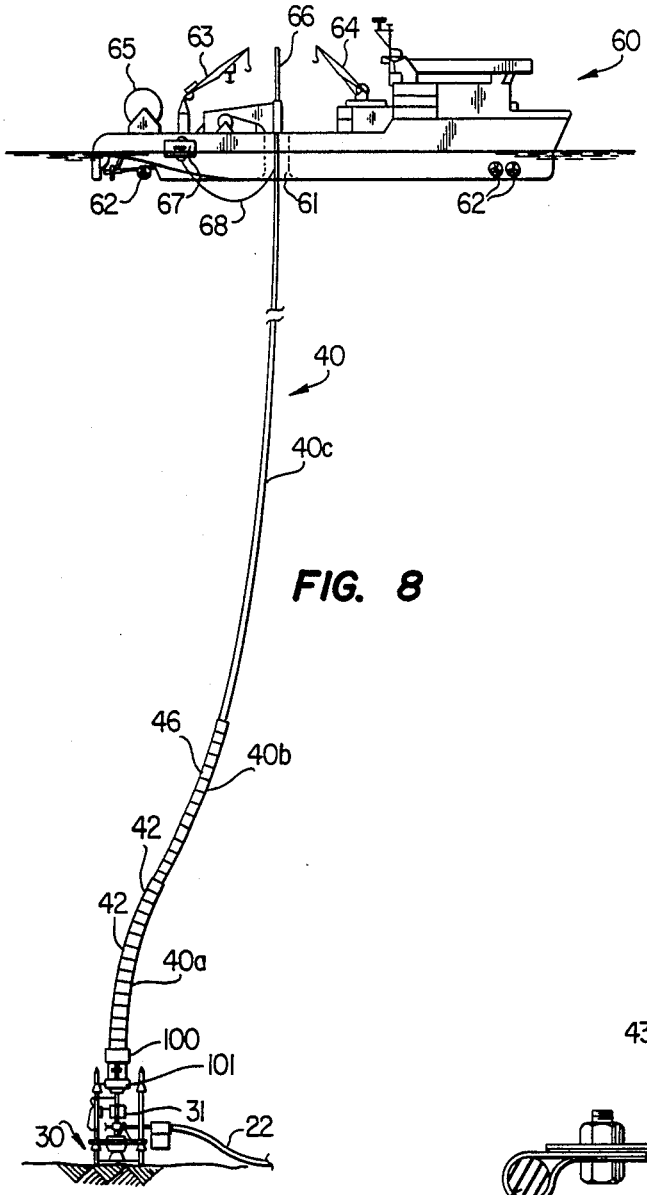
FIG. 8 is a drawing in elevation showing one embodiment of the present invention having a support vessel and flexible riser system with variable buoyancy for wireline servicing of a subsea well below the vessel.
Figure 9:
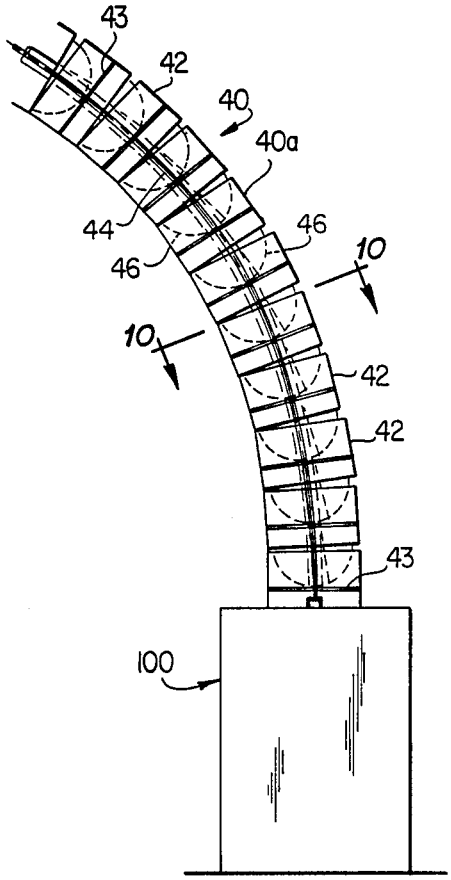
FIG. 9 is a drawing in elevation showing the flexibility of buoyancy cans attached to the lower portion of the flexible riser.
Figure 11:
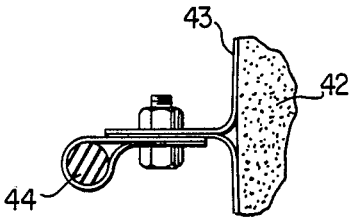
FIG. 11 is a fragmentary section showing the attachment of a wire rope support to a buoyancy can.
Figure 12:
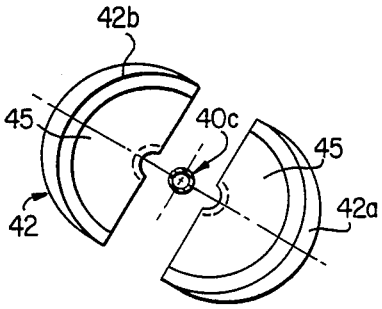
FIG. 12 is a detailed drawing showing the parts of a buoyancy can prior to attachment to the flexible riser.
Figure 10:
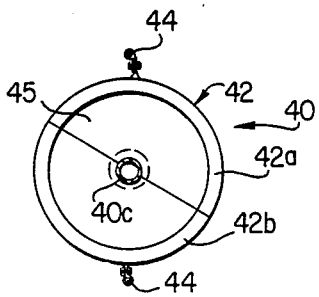
FIG. 10 is a vertical section taken along line 10—10 of FIG. 9.

Flexible riser means 40 preferably has variations in buoyancy along its length as shown in FIG. 8. Wireline servicing can best be performed in a vertical riser having no bends. However, maintaining a truly vertical riser over a fixed subsea wellhead requires expensive, sophisticated positioning equipment typically associated with a drilling vessel or semisubmersible. Varying the buoyancy of flexible riser means 40 results in a shallow S configuration which can accommodate a greater offset between support vessel 60 and the point directly above wellhead 30. The shallow S configuration which may cause some increased friction as the wireline rubs against the inside diameter of flexible riser means 40 still provides acceptable wireline characteristics. Also the shallow S configuration can accommodate movement of support vessel 60 from wave action without the need for attaching heavy motion compensators to flexible riser means 40 at the surface. Some motion compensation may be required while mating lower riser package 100 with tree 31.

The variation in buoyancy will depend upon many factors including water depth, anticipated sea state, position keeping ability of support vessel 60, inside diameter of flexible riser means 40, and associated friction factors for wireline. Flexible riser means 40 shown in FIG. 8 has a positive buoyancy portion 40*a* over approximately one-sixth of its length adjacent to lower riser package 100. A neutrally buoyant portion 40*b* has approximately the same length and is located adjacent to portion 40*a*. The remaining portion 40*c* would have standard (generally negative) buoyancy for the selected flexible riser. The ratio of 1/6:1/6:2/3 is preferred for wireline servicing of many existing subsea wells.

One method to obtain the desired buoyancy characteristics for riser portion 40*a* is to attach a plurality of buoyancy cans 42 manufactured from a suitable material such as closed cell foam. Each buoyancy can 42 has two separate halves 42*a* and 42*b* which fit snugly around standard riser 40*c*. Banding straps 43 are secured around the two halves 42*a* and 42*b*. To assist with handling, two or more wire cables 44 are attached to lower riser package 100 and the exterior of buoyancy cans 42. The upper end of each can 42 has a concave surface 45 to receive a matching convex surface 46 on the lower end of the adjacent can 42. Surfaces 45 and 46 cooperate to allow limited flexing of riser portion 40*a* without damaging buoyancy cans 42.

Figure 15:
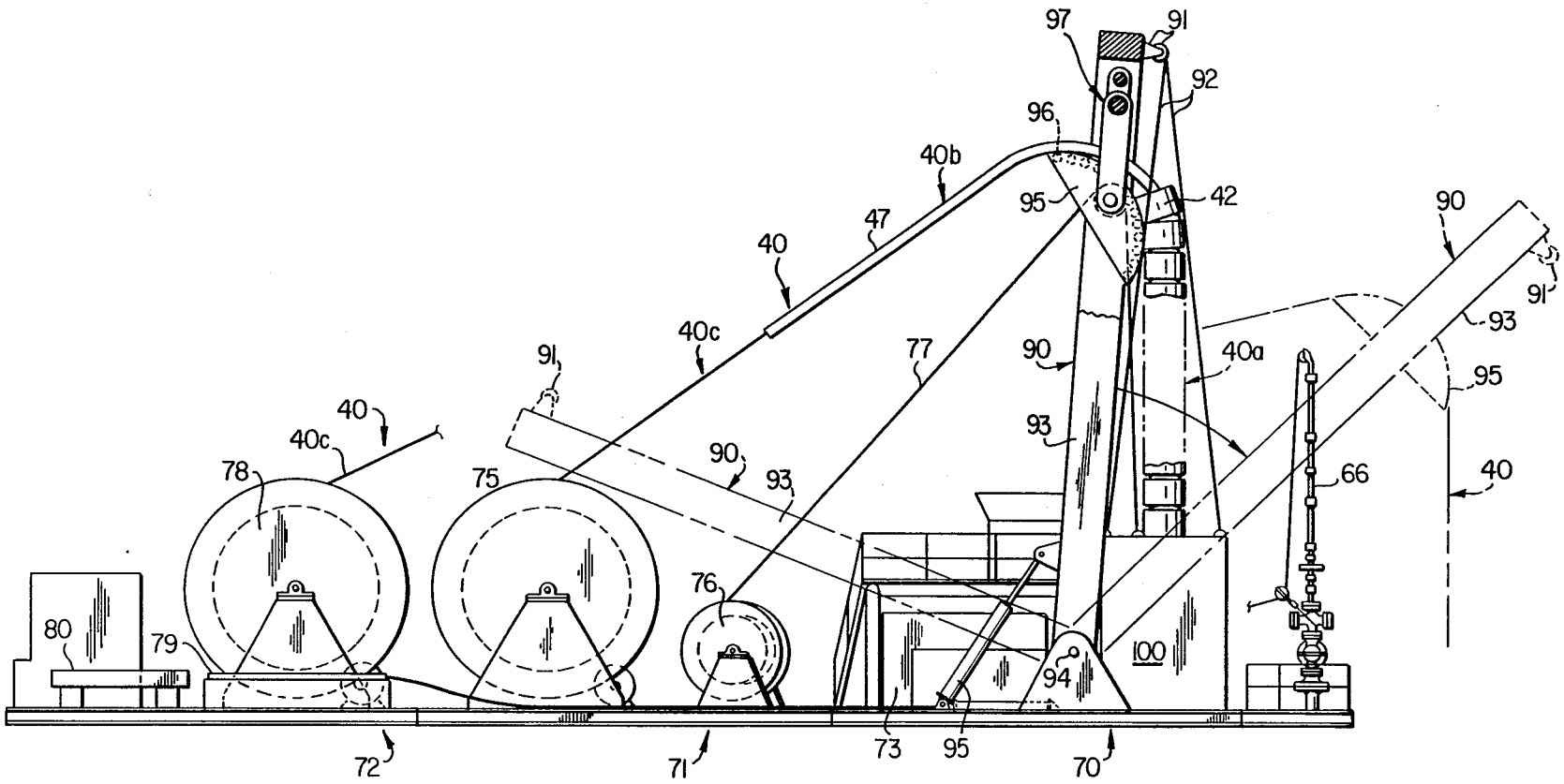
FIG. 15 is a drawing in elevation with portions broken away showing modular equipment packages used to deploy and operate the flexible riser maintenance system.

Neutrally buoyant portion 40*b* may be formed in a manner similar to riser portion 40*a* by using smaller diameter cans 42. Alternatively, a buoyant sheath or covering 47 could be placed on the exterior of riser means 40 as shown in FIG. 15. Standard riser 40*c* is available from several manufacturers including Coflexip S.A., 23, avenue de Neuilly, 75116 Paris, France. Three inches would be a typical inside diameter for standard riser 40*c*.

Figure 16:
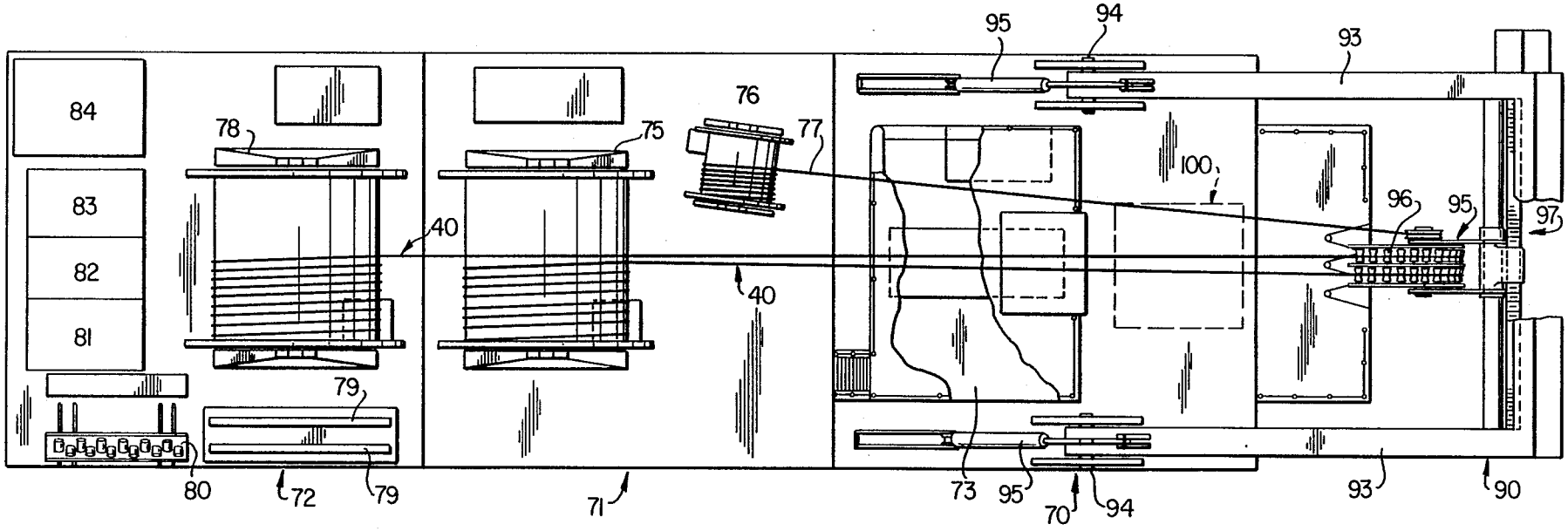
FIG. 16 is a plan view of the modular equipment packages shown in FIG. 15.

Modular equipment packages 70, 71, and 72, shown in FIGS. 15 and 16, can be easily transferred from one support vessel to another. Equipment packages 70, 71, and 72 include means for raising, lowering, and attaching flexible riser means 40 to wellhead 30. Modular equipment packages 70, 71 and 72 also include means for performing maintenance on subsea well 20 via flexible riser means 40. Equipment package 70 includes handling boom or davit 90 and enclosed control station 73. Equipment package 71 has first powered reel 75 to pay out, take up, and store flexible riser means 40 along with second powered reel 76 to pay out, take up, and store umbilical cable 77. Umbilical cable 77 provides electro/hydraulic power and monitoring/control lines to lower riser package 100. Enclosed control station 73 has the necessary panels, gauges, meters, monitoring equipment, etc., to allow operation of lower riser package 100, Christmas tree 31 and other components associated with wellhead 30 via umbilical cable 77.

For wireline servicing of well bore 21, only equipment packages 70 and 71 are required. For TFL servicing of a subsea well, an additional equipment package 72 is required. Package 72 includes second powered reel 78 with a second flexible riser means 40, TFL lubricators 79, TFL loading tray 80, and other TFL surface components 81–84.

Handling boom 90 is used to move lower riser package 100 between its stored positions as shown in FIG. 15 and its launch position over the water (not shown). Winch 91 is attached to the top of boom 90 to lift lower riser package 100 by cables 92. Boom 90 is preferably a modified (parallel legs) davit. Each leg 93 of boom 90 is attached to equipment package 70 by pivot pins 94. Hydraulic cylinders and rams 95 are provided to rotate boom 90 between three positions—stored, lifting, and operating. In its operating position, boom 90 can launch and recover lower riser package 100.

Fairlead tray 95 is carried by boom 90 to receive flexible riser means 40 therein. Fairlead tray 95 has a radius of curvature selected to accommodate riser means 40. A plurality of roller 96 are carried by fairlead tray 95 to allow flexible riser means 40 to freely move therethrough. Boom 90 includes level wind means 97 to reciprocate fairlead tray 95 between legs 93 as riser means 40 is paid out or taken up. Level wind means 97 prevents fouling of riser means 40 on powered reels 75 and 78.

Operating Sequence

A system for servicing subsea well 20 via flexible riser means 40 must accomplish four functions: guidance during landing and release from wellhead 30, structural connection to subsea tree 31, vertical access to well bore 21, and control of both well bore 21 and tree 31. The operating procedures for servicing subsea well 20 can be divided into four stages: preparation, establishing the flexible riser maintenance system, normal operations, and emergency disconnect. Typical operating limits or criteria are attached as Exhibit A at the end of this written specification.

Preparation

This stage involves selecting a support vessel 60 with adequate position keeping capability and deck space for modular support equipment 70, 71, and 72 (if required). The desired length of flexible riser means 40 is spooled onto powered reel 75 (and 76 if required). The specific tree running tool and adapter which matches subsea tree 31 is attached to lower riser package 100 as tieback tool 101. An analysis of the docking steps and normal operation is conducted to determine the optimum configuration for flexible riser means 40 and the offset of vessel 60 from wellhead 30. Water depth and weather conditions are two of the most important variables that affect the preparation stage.

Establising the System

Diver assistance could be used to attach flexible riser means 40 to subsea tree 31. However, the present invention is particularly adapted to allow all underwater connections to be made by the use of remotely operated vehicle (ROV) 160. Various types of miniature, unmanned submarines are commercially available for use as ROV 160. Examples of some remotely operated vehicles are shown in U.S. Pat. No. 2,060,670 to H. Hartman; 3,626,703 to N. F. Richburg; and 4,034,568 to B. H. Mason. The use of ROV 160 also eliminates the need for guidelines between support vessel 60 and wellhead 30.

Figure 13:
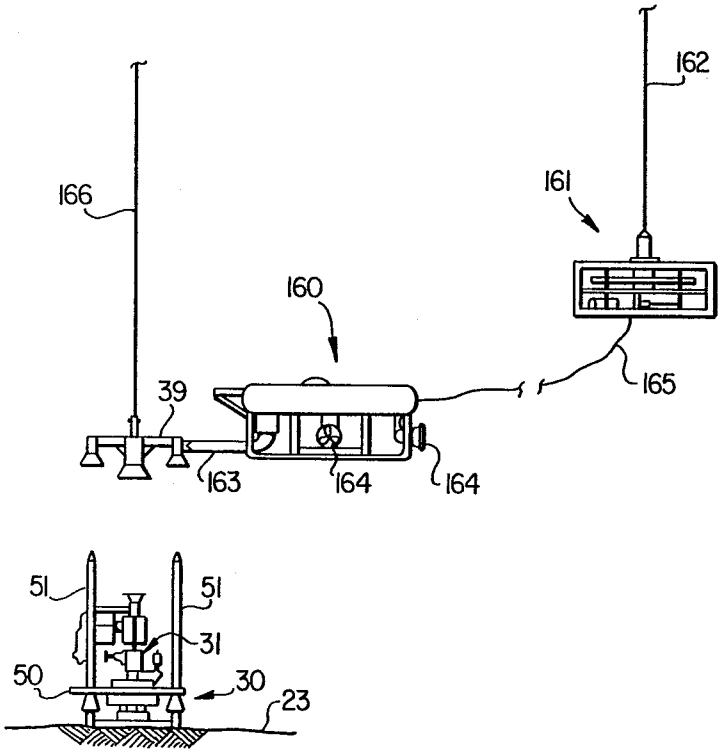
FIG. 13 is a schematic drawing in elevation showing a remotely operated vehicle (ROV) removing a tree cap from a subsea Christmas tree.

FIG. 13 shows ROV 160 removing tree cap 39 from subsea tree 31. Preferably, ROV 160 and its transport frame 161 would be a self-contained unit that could be lowered as a package by power cable 162 from support vessel 60. ROV 160 includes manipulator arm 163 and thrusters 164. Commands to and information from ROV 160 are communicated with support vessel 60 via power cable 162 and control cable 165. Thrusters 164 are used to move ROV 160 vertically and horizontally.

After support vessel 60 has arrived in the general location of wellhead 30, ROV 160 is launched to attach an acoustic beacon (not shown) to wellhead 30. The beacon provides a fixed reference point for all further work. ROV 160 will next attach cable 166 from support vessel 60 to tree cap 39 and release tree cap 39 from subsea tree 31. ROV 160 cooperates with cable 166 to remove tree cap 39 without causing any damage to subsea tree 31.

One of the most critical steps is connecting lower riser package 100 to subsea tree 31. If lower riser package 100 is not properly controlled, tree 31 may be damaged with possible loss of well control. Lower riser package 100 is designed to remain in a vertical position throughout the docking step. This design is accomplished by varying the amount of buoyant material 113 such that lower riser package 200 has a negative buoyant force of at least 2000 pounds greater than the positive buoyant force of flexible riser means portion 40*a* attached thereto.

Figure 14:
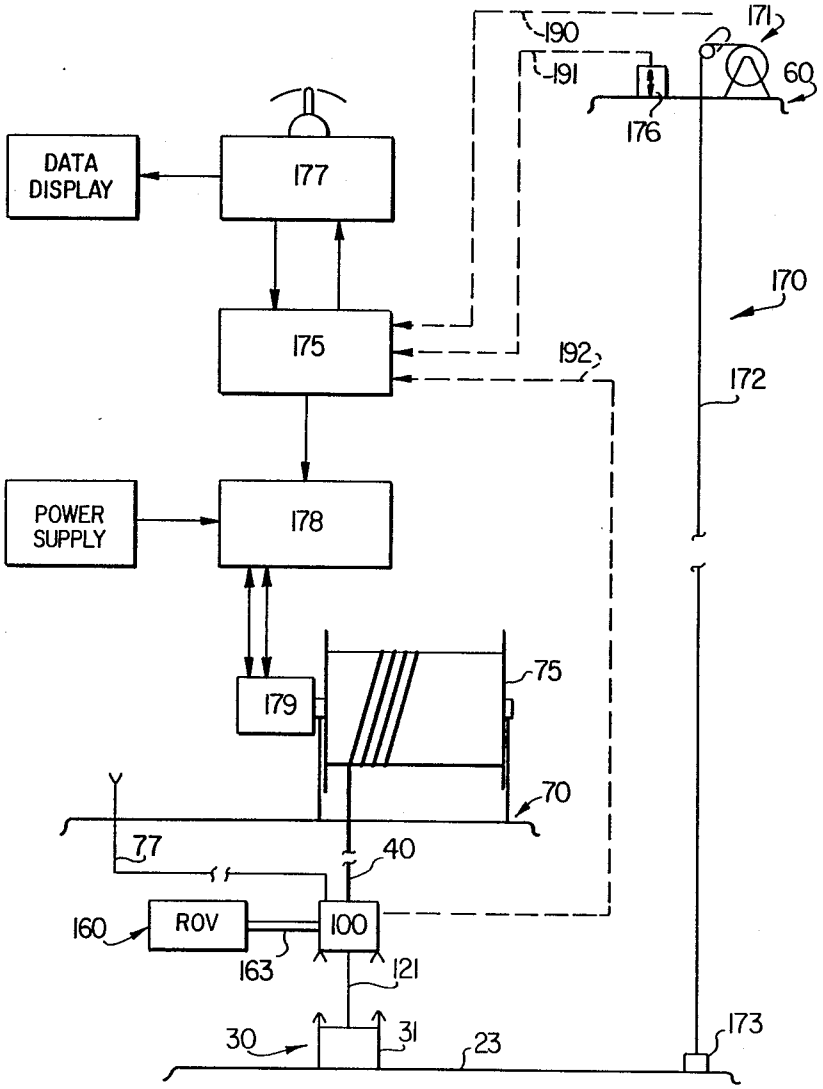
FIG. 14 is a block diagram of the hydraulic control system and winches used to attach the flexible riser with its lower riser package to a subsea wellhead.

Vertical positioning of lower riser package 100 relative to subsea tree 31 is accomplished primarily by powered reel 75 on vessel 60. Horizontal positioning of lower riser package 100 relative to subsea tree 31 is accomplished by ROV 160. Motion compensation is particularly important during the final twenty feet of descent of lower riser package 100 onto tree 31. FIG. 14 shows one system 170 to provide motion compensation for flexible riser means 40 during the docking phase.

Movement of support vessel 60 relative to ocean floor 23 is sensed by constant tension winch 171 and line 172 extending from winch 171 to weight 173 on ocean floor 23. Winch 171 provides two inputs to electronic analog controller 175. They are water depth input 190 (length of line 172 paid out) and vertical velocity input 191 from shaft encoder 176 associated with winch 171. Normal operation of powered reel 75 is accomplished by manual operator 177 sending a signal to controller 175 which in turn positions hydraulic servo controls 178 as desired. Servo controls 178 direct power fluid to hydraulic motor 179 to rotate power reel 75 to either pay out or take up flexible riser means 40.

As previously noted, lower riser package 100 includes tag line (constant tension) winch 120. ROV 160 can be used to attach tag line 121 to subsea tree 31 to measure the vertical distance (length of line 121 paid out) between lower riser package 100 and tree 31. This vertical distance is the third input 192 to electronic analog controller 175. By comparison of inputs 190, 191, and 192, controller 175 can automatically adjust the rate of descent of lower riser package 100 to a preselected value. This adjustment can be made as an override or modification of the signal from manual operator 177. An all electric system could be substituted for the electro/hydraulic system shown in FIG. 14.

Flexible riser means 40 is structurally secured to wellhead 30 via lower riser package 100 and the releasable connection between tieback tool 101 and tree 31. Control of tree 31 and downhole safety valves 26 via umbilical cable 77 is transferred to vessel 60 after docking lower riser package 100.

Normal Operation

With lower riser package 100 releasably secured to tree 31, vessel 60 is positioned at the desired offset from wellhead 30. The terminal end of riser means 40 on vessel 60 is attached either to wireline lubricator 66 or TFL lubricators 79 by appropriate quick unions (not shown). The valves in tree 31 are opened and closed as required to perform the desired downhole maintenance via flexible riser means 40. Cross connect valve 306 may be opened to flush undesired well fluids out of flexible riser means 40. After the well maintenance has been completed, the tree valves are closed and lower riser package 100 released from tree 31. ROV 160 can assist with release as required by the specific tree design. Power reel 75 is used to retrieve flexible riser means 40 and lower riser package 100. Handling boom 90 is attached to lower riser package 100 when it nears the surface to lift lower riser package 100 out of the water and to return it in its stored position on modular equipment package 70. Tree cap 39 is installed on tree 31 by ROV 160 and the sonic beacon recovered. Well 20 is then ready to resume normal production via flow lines 22.

Emergency Disconnect

Emergency disconnect of flexible riser means 40 should be a very infrequent event because normal disconnect is not a very lengthy or complicated procedure. Lower riser package 100 includes blowout preventers 110 and 111 which should be selected to shear off any tool used in the service tool string and form a fluid barrier in flow passageways 33 and 34. Blowout preventers 110 and 111 provide primary closure against well pressure during emergency disconnect. The valves in tree 31 and subsurface safety valve 26 may also close if they have not been disabled as part of the well servicing.

Preferably, a quick disconnect is located between lower riser package 100 and portion **40*a* of flexible riser means 40. Various types of quick disconnects are commercially available that will release flexible riser means 40 when a preselected amount of tension is applied. Alternatively, the upper end of flexible riser means 40 could be attached to buoy 67 and released from support vessel 60**.

Alternative Embodiments

Modular equipment package 70 and handling boom 90 can be positioned to allow deployment of flexible riser means 40 and lower riser package 100 from the stern or over the side of a support vessel. The present invention is not limited to only support vessels having moonpool 61 or a similar configuration.

The present invention is not limited to servicing single, isolated subsea wells. For example, flexible riser means 40 and lower riser package 100 can be used to service a subsea well which is part of a "subsea template" or group of subsea wells. The principal requirement is that sufficient room (offset) be available to accommodate support vessel 60 relative to the subsea wellhead that will receive lower riser package 100. Production flow line 22 could extend upwardly to any type of production facility (not shown) as long as neither flow line 22 nor the production facility blocked access to the subsea wellhead by lower riser package 100.

The present invention could be used on injection wells that maintain formation pressure and is not limited to only producing wells.

Another alternative is to combine remotely operated vehicle (ROV) 160 and lower riser package 100 into a single unit. Umbilical cable 77 could be used to provide power and control for the ROV portion of the modified lower riser package (not shown). The modified lower riser package would include thrusters, power pack, position sensors, and control system similar to ROV 160. Lower riser package 100 could also contain one or more thrusters to provide additional vertical thrust to assist ROV 160 in landing lower riser package 100 on tree 31.

Those skilled in the art will readily see additional modifications and embodiments without departing from the scope of the invention as defined in the claims.

EXHIBIT A

FLEXIBLE RISER OPERATIONAL LIMITS AND CRITERIA

| ALLOWABLE LIMIT | WIRELINE | | PUMPDOWN |
|---|---|---|---|
| RADIUS OF CURVATURE FOR TOOL PASSAGE | FOR 3" ID TOOLS | | |
| RISER ID | UNMODIFIED TOOLS | MODIFIED TOOLS | |
| 3" | 64' | 20' | 5' |

EXHIBIT A-continued

| FLEXIBLE RISER OPERATIONAL LIMITS AND CRITERIA | | | |
|---|---|---|---|
| ALLOWABLE LIMIT | WIRELINE | | PUMPDOWN |
| 4" | 20' | 5' | 5' (Must have parking tool. |
| HORIZONTAL MID-SPAN ANGLE | | | |
| POSSIBLE LOW POINT | 30°–45° | | |
| WIRE/RISER FRICTION | 20°–30° | | NOT APPLICABLE |
| LOADS | | | |
| ON TREE | $\frac{Fv}{12} + \frac{10\ Fs + M}{2.31} \leqq 55$ | | $\frac{Fv}{12} + \frac{10\ Fs + M}{2.31} \leqq 55$ |
| ON RISER TENSION | 150 KIPS(3" ID - 5000 psi) | | 150 KIPS(3" ID - 5000 psi) |
| BENDING | MIN. 2.6 FT. (3" ID) MIN. 3.8 FT. (4" ID) | | MIN. 2.6 FT. (3" ID) MIN. 3.8 FT. (4" ID) |

We claim:

1. A system for servicing a subsea well with its wellhead located adjacent to the ocean floor and production flow lines extending therefrom along the ocean floor comprising:
   a. flexible riser means;
   b. a surface support vessel with means for raising, lowering and attaching the flexible riser means to the wellhead;
   c. means, located on the support vessel, for performing maintenance on the subsea well via the flexible riser means;
   d. a lower riser package attached to the flexible riser means; and
   e. the lower riser package including mating and sealing surfaces to releasably engage the wellhead and establish communication between the flexible riser means and the wellhead.

2. A system for servicing a subsea well with its wellhead located adjacent to the ocean floor and production flow lines extending therefrom along the ocean floor comprising:
   a. flexible riser means;
   b. a surface support vessel with means for raising, lowering and attaching the flexible riser means to the wellhead;
   c. means, located on the support vessel, for perform maintenance on the subsea well via the flexible riser means;
   d. a lower riser package attached to the flexible riser means;
   e. the lower riser package including mating and sealing surfaces to releasably engage the wellhead and establish communication between the flexible riser means and the wellhead;
   f. A positive buoyancy portion of the flexible riser means adjacent to the lower riser package;
   g. a neutral buoyancy portion of the flexible riser means, adjacent to the positive buoyancy portion; and
   h. the remainder of the flexible riser means having negative buoyancy.

3. A system for servicing subsea wells as defined in claim 2 wherein the positive buoyancy portion comprises:
   a. a plurality of buoyancy cans;
   b. each buoyancy can having two separate parts sized to fit snugly on the exterior of the flexible riser means and to be strapped thereto; and
   c. the adjacent end of each buoyancy can formed to allow limited flexing relative to each other.

4. A system for servicing subsea wells as defined in claim 1 wherein the means for raising, lowering and attaching the flexible riser means further comprises:
   a. a handling boom to move the lower riser package between its stored position on the vessel and launch position over the water;
   b. a powered reel to pay out, take up, and store the flexible riser means; and
   c. a remotely operated vehicle carried by the support vessel to prepare the subsea wellhead and to assist with attaching the lower riser package thereto.

5. A system for servicing subsea wells as defined in claim 4 further comprising:
   a. modular equipment packages which can be transferred from one support vessel to another;
   b. the handling boom including a level wind means to assist with pay out and retrieval of the flexible riser means; and
   c. a winch and cable to lift the lower riser package to allow movement by the handling boom.

6. A system for servicing subsea wells as defined in claim 1 wherein the means for performing maintenance on the subsea well further comprises:
   a. a wireline lubricator;
   b. means for attaching the wireline lubricator to the terminal end of the flexible riser means on the support vessel; and
   c. wireline reel and associated equipment to conduct wireline servicing of the subsea well via the wireline lubricator and flexible riser means.

7. A system for servicing subsea wells as defined in claim 1 wherein the means for performing maintenance on the subsea well further comprises:
   a. through the flow line (TFL) lubricators;
   b. means for attaching the TFL lubricators to the terminal end of the flexible riser means on the support vessel; and
   c. TFL pumping unit and associated equipment to conduct TFL servicing of the subsea well via the TFL lubricators and flexible riser means.

8. A system for servicing subsea wells as defined in claim 1 wherein the lower riser package further comprises:
   a. a fluid flow passageway extending longitudinally therethrough;
   b. means for connecting the flexible riser means to the upper end of the passageway to establish communication therewith;
   c. blowout preventers to control fluid flow through the passageway; and d. wellhead connector means on the lower end to attach the lower riser package to the subsea wellhead.

9. A system for servicing subsea wells as defined in claim 1 wherein the lower riser package further comprises:

a. two fluid flow passageways extending longitudinally therethrough;

b. means for connecting the flexible riser means to the upper end of each passageway;

c. blowout preventers to control fluid flow through each passageway; and d. wellhead connector means on the lower end to attach the lower riser package to the subsea wellhead.

10. A system for servicing subsea wells as defined in claim 8 or 9 wherein the lower riser package further comprises:

a. a small winch and tag line for attachment to the subsea wellhead; and b. the tag line providing an indication of the distance between the lower riser package and the subsea wellhead during mating thereto.

11. A system for servicing subsea wells as defined in claim 1 further comprising:

a. an umbilical cable attached to the lower riser package;

b. the umbilical cable extending from the support vessel to the lower riser package to supply electric and hydraulic power thereto; and c. a winch carried by the support vessel to pay out, retrieve, and store the umbilical cable.

12. A flexible riser and lower riser package for servicing a subsea well with its wellhead located adjacent to the ocean floor comprising:

a. the lower riser package attached to one end of the flexible riser;

b. the lower riser package including means for releasably engaging the wellhead and establishing communication between the flexible riser means and the wellhead;

c. a positive buoyancy portion of the flexible riser means adjacent to the lower riser package;

d. a neutral buoyancy portion of the flexible riser means, adjacent to the positive buoyancy portion; and e. the remainder of the flexible riser means having negative buoyancy.

13. A flexible riser and lower riser package as defined in claim 12 wherein the positive buoyancy portion comprises:

a. a plurality of buoyancy cans;

b. each buoyancy can having two separate parts sized to fit snugly on the exterior of the flexible riser means and to be strapped thereto; and c. the adjacent end of each buoyancy can formed to allow limited flexing relative to each other.

14. A flexible riser and lower riser package as defined in claim 12 wherein the lower riser package further comprises:

a. a fluid flow passageway extending longitudinally therethrough;

b. means for connecting the flexible riser means to the upper end of the passageway to establish communication therewith;

c. blowout preventers to control fluid flow through the passageway; and d. wellhead connector means on the lower end to attach the lower riser package to the subsea wellhead.

15. A flexible riser and lower riser package as defined in claim 12 wherein the lower riser p ackage further comprises:

a. two fluid flow passageways extending longitudinally therethrough;

b. means for connecting the flexible riser means to the upper end of each passageway;

c. blowout preventers to control fluid flow through each passageway; and d. wellhead connector means on the lower end to attach the lower riser package to the subsea wellhead.

16. A flexible riser and lower riser package as defined in claim 12, 14 or 15 wherein the lower riser package further comprises:

a. a small winch and tag line for attachment to the subsea wellhead; and b. the tag line providing an indication of the distance between the lower riser package and the subsea wellhead during mating thereto.

17. A flexible riser and lower riser package for servicing a subsea well with its wellhead located adjacent to the ocean floor comprising:

a. the lower riser package attached to one end of the flexible riser;

b. a fluid flow passageway extending longitudinally through the lower riser package;

c. means for connecting the flexible riser means to the upper end of the passageway to establish communication therewith;

d. blowout preventers to control fluid flow through the passageway; and e. wellhead connector means on the lower end to releasably attach the lower riser package to the subsea wellhead.

18. A flexible riser and lower riser package as defined in claim 17 wherein the lower riser package further comprises:

a. two fluid flow passageways extending longitudinally therethrough;

b. means for connecting the flexible riser means to the upper end of each passageway;

c. blowout preventers to control fluid flow through each passageway; and d. wellhead connector means on the lower end to releasably attach the lower riser package to the subsea wellhead.

19. A flexible riser and lower riser package as defined in claim 17 wherein the lower riser package further comprises:

a. a small winch and tag line for attachment to the subsea wellhead; and b. the tag line providing an indication of the distance between the lower riser package and the subsea wellhead during mating thereto.

20. A lower riser package as defined in claim 8, 9, 14, or 17 wherein the wellhead connector means further comprises a subsea Christmas tree running tool.

21. The method of servicing a subsea well with its wellhead located adjacent to the ocean floor comprising:

a. positioning a support vessel on the ocean surface within a preselected offset from the wellhead;

b. launching a remotely operated vehicle from the support vessel to locate the wellhead and remove its tree cap;
c. deploying a flexible riser means with an attached lower riser package into the water from the support vessel;
d. guiding the lower riser package to the wellhead by the remotely operated vehicle after the wellhead has been prepared;
e. attaching the lower riser package to the wellhead to establish communication between the wellhead and flexible riser means; and
f. performing maintenance on the subsea well from the support vessel via the flexible riser means.

22. The method of servicing a subsea well as defined in claim 21 further comprising attaching buoyancy means to the flexible riser means adjacent to the lower riser package whereby the flexible riser means will have the desired vertical profile when attached to the wellhead.

23. The method of servicing a subsea well as defined in claim 21 further comprising:
a. moving the lower riser package from its stored position to a position over the water by a handling boom and winch; and
b. paying out the flexible riser means from a powered storage reel while the remotely operated vehicle guides the lower riser package to the wellhead.

24. The method of servicing a subsea well with its wellhead located adjacent to the ocean floor comprising:
a. positioning a support vessel on the ocean surface within a preselected offset from the wellhead;
b. launching a remotely operated vehicle from the support vessel to located the wellhead and remove its tree cap;
c. deploying a flexible riser means with an attached lower riser package into the water from the support vessel;
d. guiding the lower riser package to the we the remotely operated vehicle after the wellhead has been prepared;
e. attaching a first line from the lower riser package to the subsea wellhead to measure the distance therebetween; the
f. placing a second line from the support vessel to ocean floor to measure movement of the support vessel relative thereto;
g. paying out or retrieving the flexible riser means with a powered reel to control movement of the lower riser package towards the wellhead at a preselected rate in response to changes in the first and second measuring lines;
h. attaching the lower riser package to the wellhead to establish communication between the wellhead and flexible riser means; and
i. performing maintenance on the subsea well from the support vessel via the flexible riser means.

25. The method of servicing a subsea well as defined in claim 21 further comprising attaching an umbilical cable to the lower riser package to supply electric and hydraulic power thereto from the support vessel.

26. The method of servicing from a support vessel a subsea well with its wellhead located adjacent to the ocean floor comprising:
a. combining a remotely operated vehicle and a lower riser package into a single unit which can be launched with a flexible riser means;
b. attaching an umbilical cable to the lower riser package to supply electric and hydraulic power thereto from the support vessel;
c. positioning the support vessel on the ocean surface within a preselected offset from the wellhead;
d. deploying the flexible riser means with the single unit attached thereto into the water from the support vessel;
e. supplying power and control to the remotely operated vehicle portion of the single unit from the umbilical cable;
f. locating the wellhead and removing its tree cap with the remotely operated vehicle portion of the single unit;
g. guiding the single unit to the wellhead by the remotely operated vehicle portion after the wellhead has been prepared;
h. attaching the lower riser package to the wellhead to establish communication between the wellhead and flexible riser means; and
i. performing maintenance on the subsea well from the support vessel via the flexible riser means.

27. The method of servicing a subsea well as defined in claim 21 further comprising attaching a wireline lubricator to the terminal end of the flexible riser means at the support vessel to perform wireline maintenance of the subsea well via the flexible riser means.

28. The method of servicing a subsea well as defined in claim 21 further comprising attaching through the flow line (TFL) lubricators to the terminal end of the flexible riser means at the support vessel to perform TFL maintenance of the subsea well via the flexible riser means.

* * * * *